US010150630B2

(12) United States Patent
Sakuma et al.

(10) Patent No.: US 10,150,630 B2
(45) Date of Patent: Dec. 11, 2018

(54) POST-PROCESSING APPARATUS AND IMAGE FORMING SYSTEM

(71) Applicant: FUJI XEROX CO., LTD., Tokyo (JP)

(72) Inventors: Akira Sakuma, Kanagawa (JP); Shinji Masaki, Kanagawa (JP); Kenji Suzuki, Kanagawa (JP); Katsushi Amarume, Kanagawa (JP); Takeshi Ichikawa, Nagano (JP)

(73) Assignee: FUJI XEROX CO., LTD., Tokyo (JP)

( * ) Notice: Subject to any disclaimer, the term of this patent is extended or adjusted under 35 U.S.C. 154(b) by 28 days.

(21) Appl. No.: 15/592,548

(22) Filed: May 11, 2017

(65) Prior Publication Data

US 2018/0009615 A1 Jan. 11, 2018

(30) Foreign Application Priority Data

Jul. 5, 2016 (JP) ..... 2016-133184

(51) Int. Cl.

| | |
|---|---|
| ***B65H 35/02*** | (2006.01) |
| ***G03G 15/00*** | (2006.01) |
| ***B65H 5/36*** | (2006.01) |
| ***B65H 31/00*** | (2006.01) |

(52) U.S. Cl.

CPC ..... *B65H 5/36* (2013.01); *B65H 31/00* (2013.01); *B65H 35/02* (2013.01); *G03G 15/6582* (2013.01); *B65H 2403/41* (2013.01); *B65H 2801/27* (2013.01); *G03G 2215/00814* (2013.01)

(58) Field of Classification Search

CPC . G03G 2215/00814; B65H 37/06; B26D 7/18
See application file for complete search history.

(56) References Cited

U.S. PATENT DOCUMENTS

| | | | | |
|---|---|---|---|---|
| 5,737,987 | A * | 4/1998 | Olson | B65H 31/20 271/207 |
| 7,461,578 | B2 * | 12/2008 | Tamura | B26D 7/18 399/407 |
| 2008/0112018 | A1 * | 5/2008 | Sato | B26D 7/18 358/468 |
| 2015/0001782 | A1 * | 1/2015 | Sakuma | G03G 15/6582 270/21.1 |

FOREIGN PATENT DOCUMENTS

| | | | |
|---|---|---|---|
| JP | 2004-331328 | A | 11/2004 |
| JP | 2009-126690 | A | 6/2009 |
| JP | 2011-126647 | A | 6/2011 |

* cited by examiner

*Primary Examiner* — Jennifer Simmons
(74) *Attorney, Agent, or Firm* — Oliff PLC

(57) ABSTRACT

A post-processing apparatus includes a side edge part removing portion that removes a side edge part from a sheet; a side edge part housing portion that houses the removed side edge part and is able to be pulled out from an apparatus body; a guide plate that is inclined in a direction intersecting with a moving direction of the side edge part and guides the removed side edge part along the moving direction to the housing portion; and a second guide plate that is arranged between the housing portion and the guide plate, and is transformable into a first form having substantially mountain-shaped inclined surfaces in which both end portions of the second guide plate along the moving direction are lower than a center portion thereof, and a second form having substantially valley-shaped inclined surfaces in which both the end portions are higher than the center portion.

4 Claims, 9 Drawing Sheets

POST-PROCESSING APPARATUS AND IMAGE FORMING SYSTEM

CROSS-REFERENCE TO RELATED APPLICATIONS

This application is based on and claims priority under 35 USC 119 from Japanese Patent Application No. 2016-133184 filed Jul. 5, 2016.

BACKGROUND

Technical Field

The present invention relates to a post-processing apparatus and an image forming system.

SUMMARY

According to an aspect of the invention, there is provided a post-processing apparatus including a side edge part removing portion that removes a side edge part from a sheet; a side edge part housing portion that houses the side edge part of the sheet removed by the side edge part removing portion and that is able to be pulled out from an apparatus body; a guide plate that is inclined in a direction intersecting with a moving direction of the side edge part and guides the side edge part removed by the side edge part removing portion along the moving direction of the side edge part to the side edge part housing portion; and a second guide plate that is arranged between the side edge part housing portion and the guide plate, and is able to be transformed into a first form having substantially mountain-shaped inclined surfaces in which both end portions of the second guide plate along the moving direction of the side edge part are lower than a center portion of the second guide plate, and a second form having substantially valley-shaped inclined surfaces in which both the end portions are higher than the center portion.

BRIEF DESCRIPTION OF THE DRAWINGS

An exemplary embodiment of the present invention will be described in detail based on the following figures, wherein.

DETAILED DESCRIPTION

The present invention is described in detail below according to an exemplary embodiment and specific examples with reference to the drawings. However, the present invention is not limited to the embodiment and specific examples.

Also, in the description with reference to the drawings, it is to be noted that the drawings are schematic drawings and the ratio of respective dimensions etc. is different from the actual value. For easier understanding, illustration of members other than the members required for explanation are omitted as appropriate.

(1) General Configuration and Operation of Image Forming System

Figure 1:
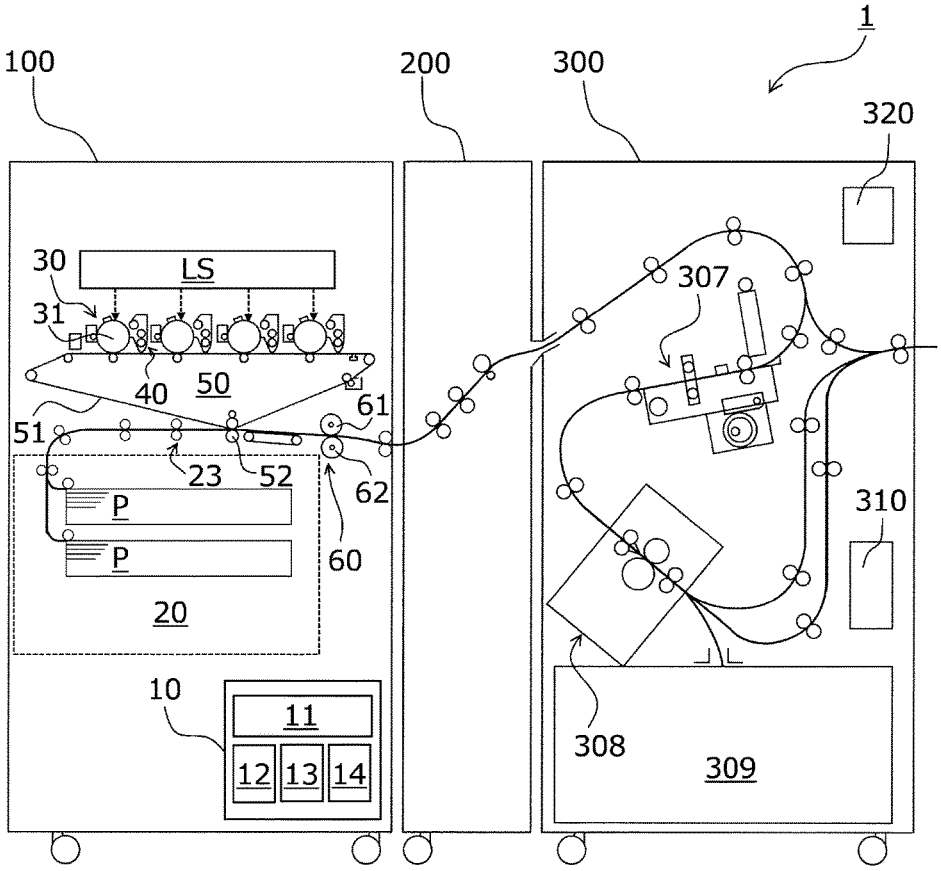
FIG. 1 is a schematic sectional view showing an inside configuration of an image forming system.

FIG. 1 is a schematic sectional view showing an inside configuration of an image forming system 1 to which this exemplary embodiment is applied. The image forming system 1 shown in FIG. 1 includes an image forming apparatus 100, such as a printer or a copier, that forms an image by an electrophotographic system, a transport apparatus 200 that guides a sheet P with an image recorded to a post-processing apparatus 300, and the post-processing apparatus 300 that provides post-processing on the sheet P with a toner image formed by the image forming apparatus 100.

A general configuration and an operation of the image forming system 1 are described below with reference to the drawings.

(1.1) General Configuration and Operation of Image Forming Apparatus

The image forming apparatus 100 includes a control device 10, a sheet feed device 20, a photoconductor unit 30, developing devices 40, a transfer device 50, a fixing device 60, and an exposure device LS.

The control device 10 includes an image forming apparatus controller 11 that controls an operation of the image forming apparatus 100, a controller 12 that prepares image data in accordance with a print processing request, an exposure controller 13 that controls lighting of the exposure device LS, and a power supply device 14. The power supply device 14 supplies predetermined electric power to the photoconductor unit 30, the developing devices 40, the transfer device 50, the fixing device 60, and the exposure device LS.

The sheet feed device 20 in which sheets P as recording media are stacked is provided in a bottom portion of the image forming apparatus 100. The position in the width direction of the sheets P is determined by a regulation plate (not shown). The sheets P are drawn one by one from the top to the front, and then the drawn sheet P is transported to a nip part of a registration roller pair 23.

The photoconductor unit 30 includes photoconductor drums 31 that are arranged above the sheet feed device 20 in parallel to one another and that are rotationally driven. The developing devices 40 form toner images of yellow (Y), magenta (M), cyan (C), and black (K) respectively on the photoconductor drums 31.

The toner images of the respective colors formed on the photoconductor drums 31 of the photoconductor unit 30 are sequentially electrostatically transferred (first transfer) on an intermediate transfer belt 51 of the transfer device 50, and thereby superimposed toner images in which the toners of the respective colors are superimposed are formed. The superimposed toner images on the intermediate transfer belt 51 are collectively transferred by a second transfer roller 52, on the sheet P sent out from the registration roller pair 23 and guided by a transport guide.

The sheet P with the toner images collectively transferred in the transfer device 50 is transported to the fixing device 60 in a state in which the toner images are not fixed. The toner images are fixed by an action of pressure and heat by a pair of a heat module 61 and a pressure module 62.

The sheet P with the fixed toner images formed is guided by a transport guide (not shown), and is transported through the transport apparatus 200 to the post-processing apparatus 300.

(1.2) General Configuration and Operation of Post-Processing Apparatus

The post-processing apparatus 300 includes a crease forming section 307 that forms creases on the sheet P received from the transport apparatus 200, a side edge part removing section (top and bottom trimmer) 308 that removes side edge parts CP of the sheet P, and a sheet-waste housing section 309 that houses the removed side edge parts CP of the sheet P as waste.

Further, the post-processing apparatus 300 includes a post-processing controller 310 that includes a central processing unit (CPU) and a read-only memory (ROM) and that controls respective functional sections of the post-processing apparatus 300. The post-processing apparatus 300 also includes a user interface (UI) 320 that receives an operation input from a user and relating to the post-processing.

In the image forming system 1, a finisher device may be connected subsequently to the post-processing apparatus 300 for sheets P output from the post-processing apparatus 300. The finisher device includes, for example, a compile tray that aligns and compiles the sheets P, an end binding mechanism (stapler) that binds end portions of the sheets P, and a center folding and binding processing mechanism that provides center folding and binding processing to make a booklet.

With such a system configuration, the image forming system 1 may continuously execute, for example, a series of works (print units) for creating a booklet.

(2) Transport Apparatus

Figure 2:
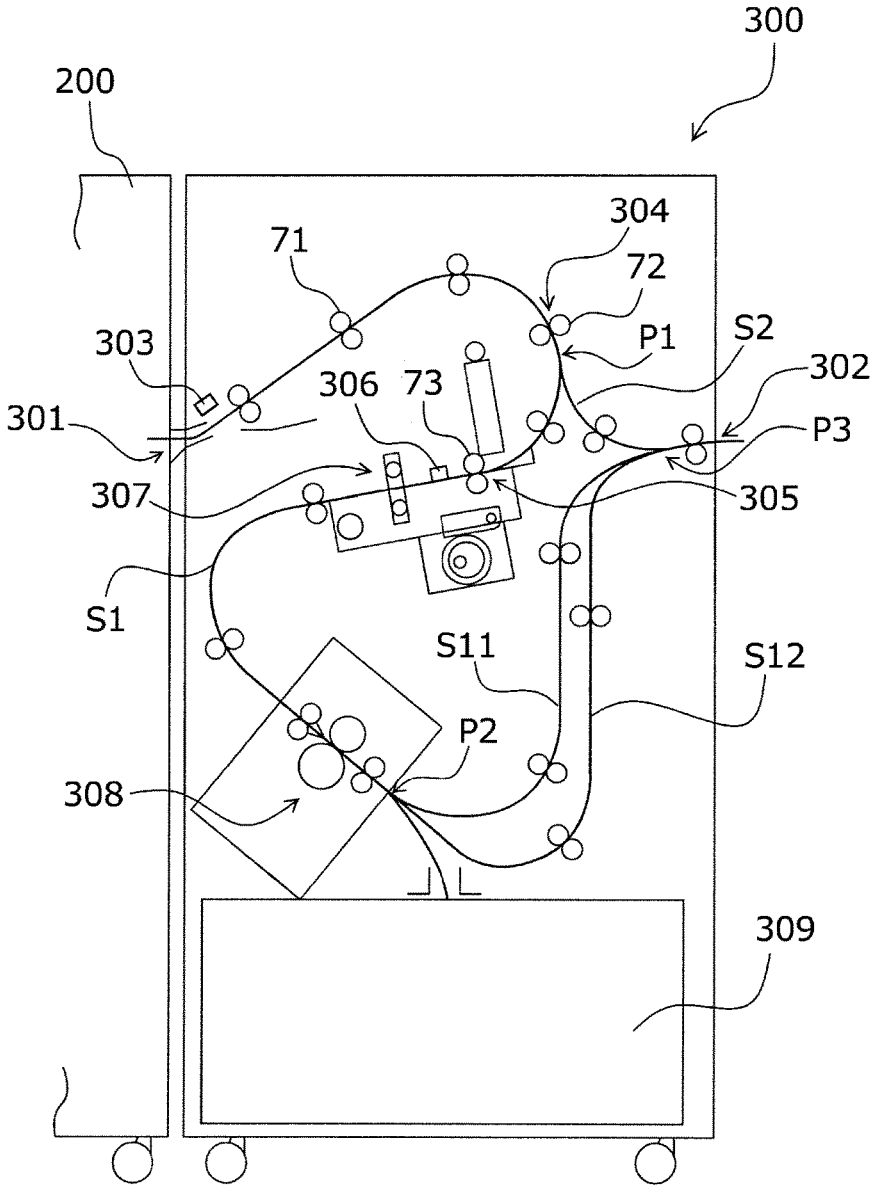
FIG. 2 is a schematic sectional view of a post-processing apparatus according to an exemplary embodiment.
Figure 3A:
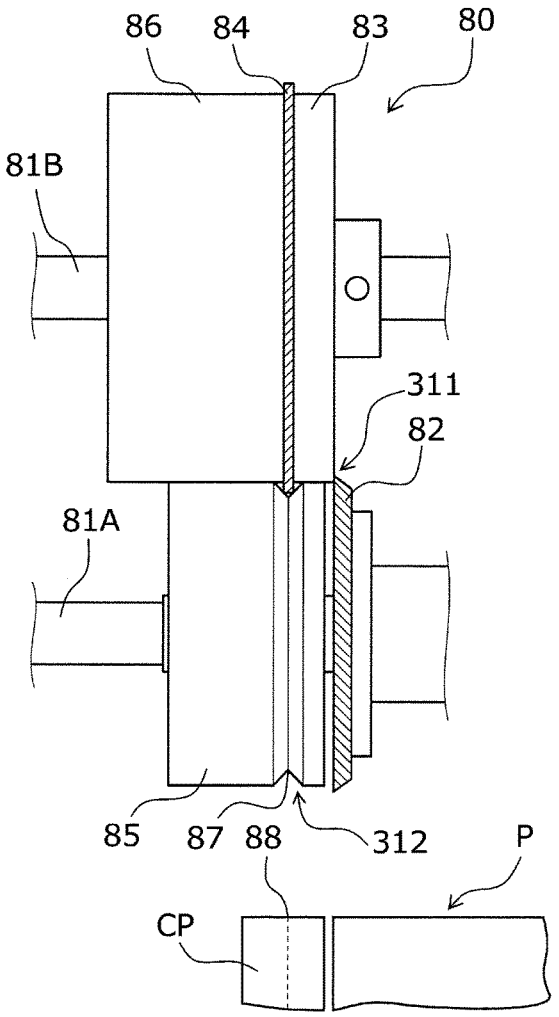
FIG. 3A illustrates a structure of a cutter unit included in a side edge part removing section.
Figure 3B:
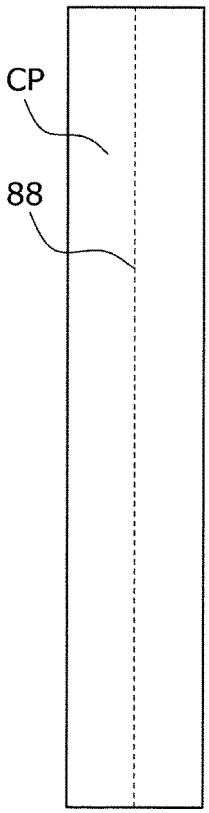
FIG. 3B illustrates a side edge part of a sheet.
Figure 4B:
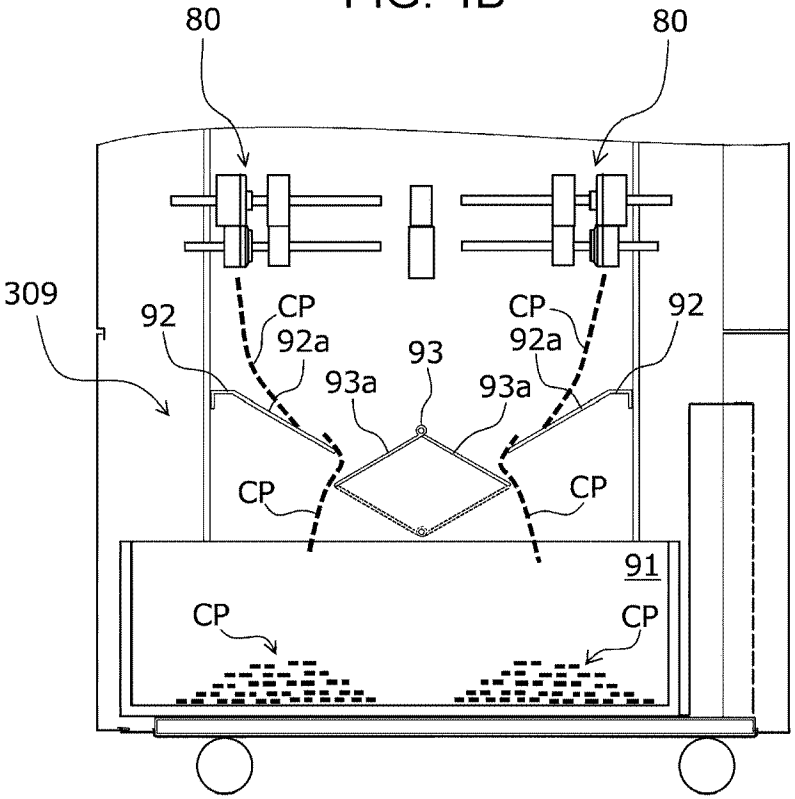
FIG. 4B is a schematic cross section of the sheet-waste housing section.
Figure 4A:
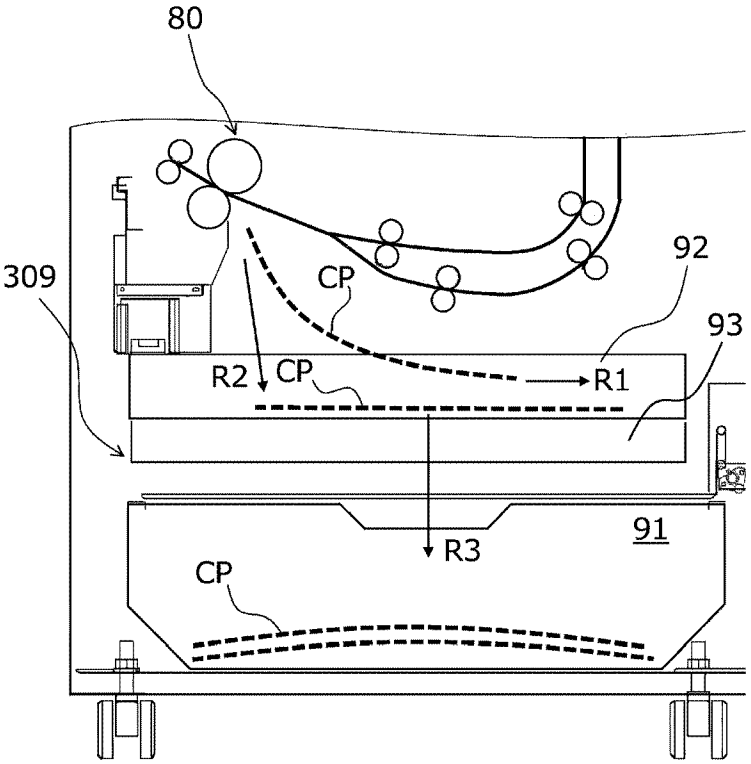
FIG. 4A is a schematic longitudinal section of a sheet-waste housing section.
Figure 5:
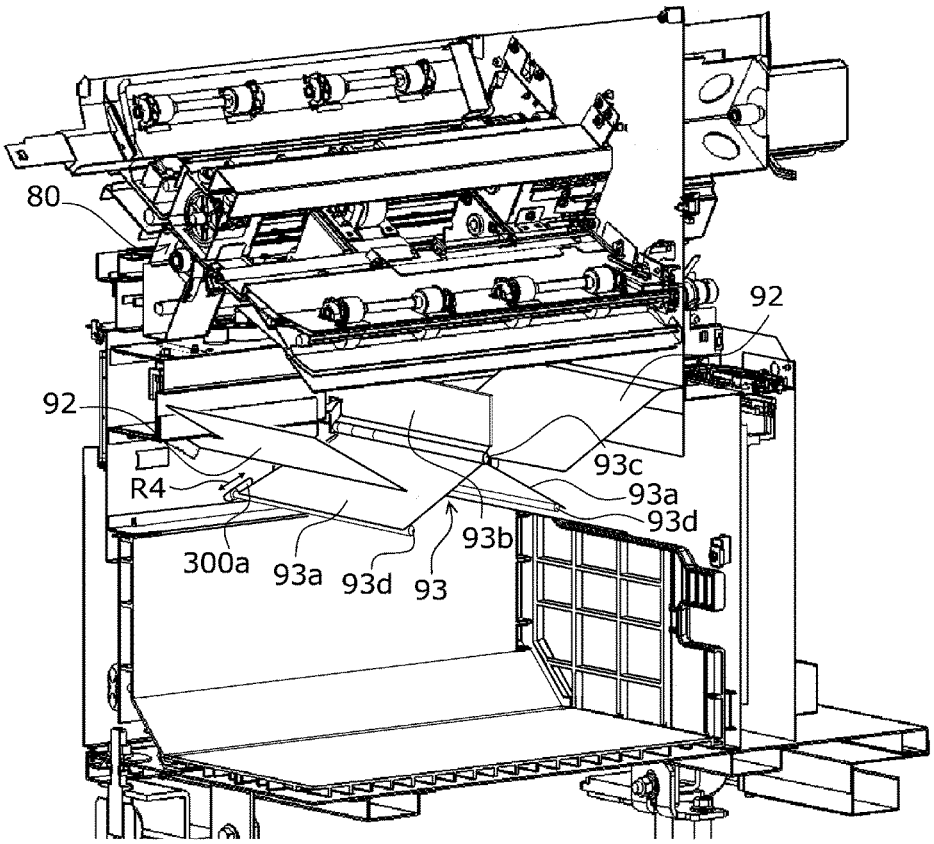
FIG. 5 is a perspective sectional view showing the sheet-waste housing section of the post-processing apparatus.
Figure 6:
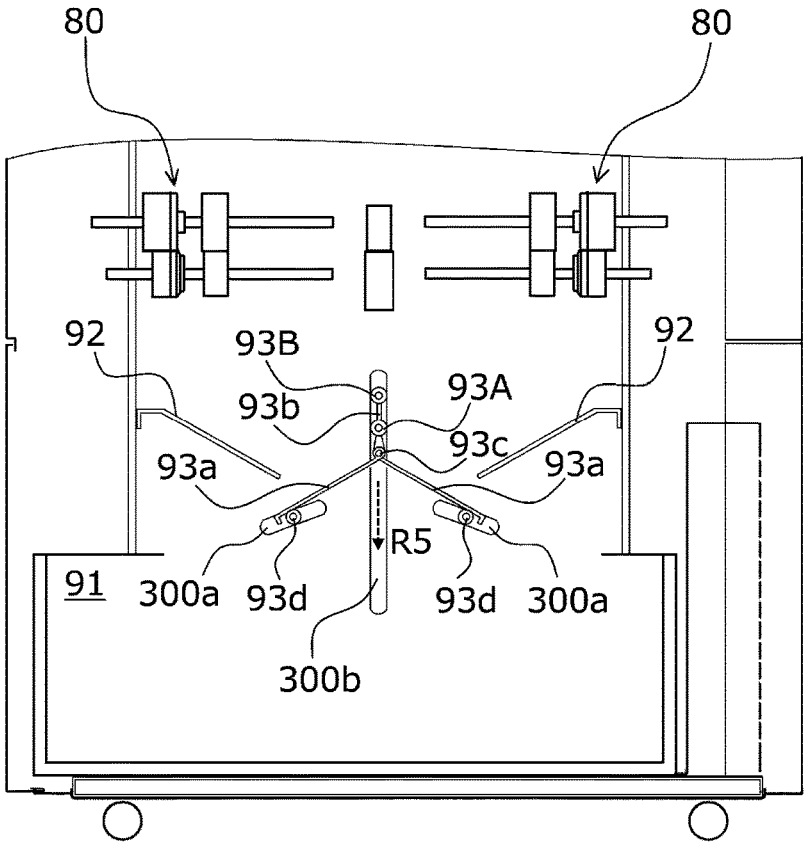
FIG. 6 is a schematic cross section showing the sheet-waste housing section of the post-processing apparatus.
Figure 7:
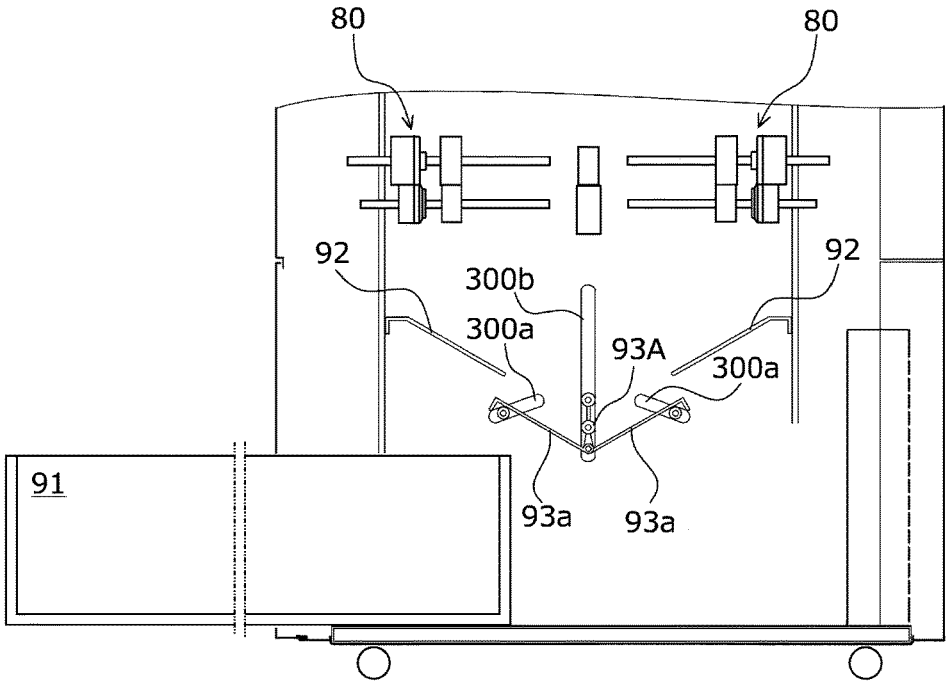
FIG. 7 is a schematic cross section showing the sheet-waste housing section in a state in which a sheet-waste housing box is pulled out.

FIG. 2 is a schematic sectional view of the post-processing apparatus 300. FIG. 3A illustrates a structure of a cutter unit 80 included in the side edge part removing section 308, and FIG. 3B illustrates a side edge part CP of a sheet P. FIG. 4A is a schematic longitudinal section of a sheet-waste housing section 309, and FIG. 4B is a schematic cross section of the sheet-waste housing section 309. FIG. 5 is a perspective sectional view showing the sheet-waste housing section 309 of the post-processing apparatus 300. FIG. 6 is a schematic cross section showing the sheet-waste housing section 309 of the post-processing apparatus 300. FIG. 7 is a schematic cross section showing the sheet-waste housing section 309 in a state in which a sheet-waste housing box 91 is pulled out.

A configuration and an operation of the post-processing apparatus 300 are described below with reference to the drawings.

(2.1) General Configuration

As shown in FIG. 2, the post-processing apparatus 300 has a reception port 301 for receiving the sheet P transported from the image forming apparatus 100, and an output port 302 for outputting the sheet P.

Also, the post-processing apparatus 300 includes a skew detector 303 that detects skew of the received sheet P with respect to a transport direction of the sheet P, a first tilt corrector 304 having swing rollers 72 that correct skew, a second tilt corrector 305 that corrects skew by bringing the leading end of the sheet P into contact with skew correction rollers 73, a side detector 306 that detects the positions of both ends of the sheet P, the crease forming section 307 that forms creases on the sheet P, the side edge part removing section (top and bottom trimmer) 308 that removes side edge parts CP of the sheet P, and the sheet-waste housing section 309 that houses the removed side edge parts CP of the sheet P as sheet waste.

(2.2) Sheet Transport Path

The post-processing apparatus 300 has a first sheet transport path S1 as a transport path of the sheet P. The first sheet transport path S1 extends from the reception port 301 as a start point to the output port 302.

Also, the first sheet transport path S1 is provided to pass through the skew detector 303, the first tilt corrector 304, the second tilt corrector 305, the side detector 306, the crease forming section 307, and the side edge part removing section (top and bottom trimmer) 308.

With the first sheet transport path S1, the sheet P received at the reception port 301 is transported to the skew detector 303, the first tilt corrector 304, the second tilt corrector 305, the side detector 306, the crease forming section 307, and the side edge part removing section 308.

The first sheet transport path S1 branches into a first branch path S11 and a second branch path S12 at a position located downstream of the side edge part removing section 308 (see P2 in FIG. 2). The first branch path S11 and the second branch path S12 join into one at a position located upstream of the output port 302 (see P3 in FIG. 2).

Further, the post-processing apparatus 300 has a second sheet transport path S2 branching from the first sheet transport path S1.

The second sheet transport path S2 branches from the first sheet transport path S1 at a position located downstream of the first tilt corrector 304 and upstream of the crease forming section 307 (see P1 in FIG. 2). The second sheet transport path S2 extends from a position at which the second sheet transport path S2 is connected with the first sheet transport path S1 as a start point to the output port 302.

A sheet P the creases of which are not formed by the crease forming section 307 and the side edge parts of which are not removed by the side edge part removing section 308 is transported through the second sheet transport path S2 to the output port 302.

The branch point (P1) at which the second sheet transport path S2 branches from the first sheet transport path S1, the branch point (P2) at which the first sheet transport path S1 branches into the first branch path S11 and the second branch path S12, and the joint point (see P3 in FIG. 2) at which the first branch path S11, the second branch path S12, and the second sheet transport path S2 join into one are provided with gates (not shown) for switching the transport path of the sheet P.

Also, plural transport rollers 71 are provided in the first sheet transport path S1 and the second sheet transport path S2. The transport rollers 71 transport the sheet P to the downstream side in the sheet transport direction.

(2.3) Function and Operation of Post-Processing Apparatus

The skew detector 303 includes two detecting members provided in a direction intersecting with (orthogonal to) the transport direction of the sheet P. Each detecting member includes a light emitting element and a light receiving element. The skew detector 303 calculates skew in the direction intersecting with (orthogonal to) the transport direction of the transported sheet P from a time difference in shielding of light when the sheet P passes through the two detecting members.

The first tilt corrector 304 includes the swing rollers 72. The swing rollers 72 include a driving roller that is rotationally driven by a motor, and a driven roller that is rotated by contacting the driving roller and receiving a driving force from the driving roller.

First ends of shafts of the swing rollers 72 are fixed, and second ends of the shafts are able to be tilted with respect to the direction intersecting with (orthogonal to) the transport direction of the sheet P. The tilt amount of the swing rollers 72 is set in accordance with the skew amount of the sheet P detected by the skew detector 303 immediately before the sheet P arrives.

If the swing rollers 72 pinch the sheet P in a tilted state, the state is restored from the tilted state to an original non-tilted state, and the sheet P is transported in a state in which the skew of the sheet P is corrected.

The second tilt corrector 305 corrects the skew of the sheet P corrected by the first tilt corrector 304, with higher accuracy. The second tilt corrector 305 includes the skew correction rollers 73 that correct the skew by bringing the sheet P into contact with the skew correction rollers 73.

The skew correction rollers 73 are kept in a state in which rotation is stopped immediately before the sheet P contacts the skew correction rollers 73. The sheet P contacts the skew correction rollers 73 and forms a loop. The rotation of the skew correction rollers 73 is resumed at a timing at which the loop is generated, and the skew of the sheet P is corrected.

The side detector 306 detects ends of the sheet P in the direction orthogonal to the transport direction of the sheet P. For example, the positions of the ends of the sheet P are detected by line sensors. In this case, the positions of the ends in the direction orthogonal to the transport direction of the sheet P vary depending on the sheet P.

The crease forming section 307 includes advance members that advance from sides of the first sheet transport path S1 toward the first sheet transport path S1. By pressing the advance members to the sheet P, creases are formed on the sheet P. A device that provides folding processing disposed subsequently to the post-processing apparatus 300 folds the sheet P along the creases.

If the creases are not formed on the sheet P, the sheet P is transported to the side edge part removing section 308 without formation of the creases.

The side edge part removing section 308 is a device that executes trimming. The side edge part removing section 308 removes portions of side edge parts CP (side edge parts along the first sheet transport path S1) of the sheet P. The side edge part removing section 308 includes, for example, the cutter unit (rotary cutter unit) 80 (see FIG. 3A) having a shaft provided in the direction orthogonal to the transport direction of the sheet P and a disk-shaped blade fixed to the shaft.

The cutter unit 80 includes two cutter units 80 provided in the direction intersecting with (orthogonal to) the transport direction of the sheet P, and simultaneously removes side edge parts CP at both end portions of the sheet P.

The width of the sheet P varies depending on the booklet to be made. Hence the two cutter units 80 move along the shafts in accordance with the positions of the sides of the sheet P detected by the side detector 306 and the sizes of the side edge parts CP of the sheet P to be trimmed, and cut off the side edge parts CP of the sheet P.

The sheet-waste housing section 309 houses the side edge parts CP of the sheet P cut off in the side edge part removing section 308, as sheet waste.

If the sheet P is not trimmed, the sheet P is transported to the output port 302 in a state in which the side edge parts CP of the sheet P are not removed.

(2.4) Side Edge Part Removal of Sheet

As shown in FIG. 3A, each cutter unit 80 includes a cutter portion 311 being an example of a side edge part removing portion, and a line applying portion 312 that gives stiffness to the sheet waste.

The cutter portion 311 includes a rotary cutter 82 being a disk-shaped blade, and a cylindrical pressing member 83 to which the rotary cutter 82 is pressed.

The line applying portion 312 includes a disk 84 and a groove 87 that receives an outer edge of the disk 84.

The rotary cutter 82, the pressing member 83, the disk 84, and the groove 87 are arranged around shafts 81A and 81B provided in parallel to the direction orthogonal to the transport direction of the sheet P.

The rotary cutter 82 and a cylindrical elastic body 85 made of rubber and having the groove 87 are provided around the shaft 81A with a predetermined gap interposed therebetween. The pressing member 83 to which the rotary cutter 82 is pressed, the disk 84 adjacent to the pressing member 83, and a cylindrical elastic body 86 made of rubber and being adjacent to the disk 84 are provided around the shaft 81B.

The disk 84 has a larger outer diameter than the outer shape of the pressing member 83. Hence the outer periphery of the disk 84 protrudes to the outside of the pressing member 83. It is to be noted that the outer diameter of the elastic body 86 is set to be equivalent to the outer diameter of the pressing member 83.

The outer periphery of the disk 84 is inserted into the groove 87 provided in the elastic body 85, the elastic body 85 contacts the elastic body 86, and thereby a driving force is transmitted.

With this configuration, when the shaft 81A receives the rotational driving, the elastic body 85 fixed to the shaft 81A is rotated, the driving force is transmitted to the elastic body 86 fixed to the shaft 81B, and the shaft 81B is rotated.

Consequently, the side edge part CP is cut off from the sheet P pinched between the rotary cutter 82 and the pressing member 83. It is to be noted that a pressure is applied to the rotary cutter 82 and the pressing member 83 by a spring (not shown) to mesh with one another.

As shown in FIG. 3B, a line 88 is formed in the transport direction of the sheet P along the side edge part CP of the sheet P. For example, in a case where the width of the side edge part CP of the sheet P is in a range from 6 to 25 mm, to allow the line 88 to be formed even if the width of the side edge part CP of the sheet P is 6 mm which is the narrowest, the line 88 is formed along the long and narrow side edge part CP at a 4-mm position from the rotary cutter 82.

The side edge part CP with the line 88 formed is not easily bent in a direction orthogonal to the line 88 as compared with a case without the line 88. The stiffness in the sheet transport direction of the side edge part CP is increased, the side edge part CP is not easily bent, and the rod shape is easily kept.

Consequently, as shown in FIG. 2, the side edge part CP of the sheet P trimmed by the cutter unit 80 advances in an oblique direction (in the lower right direction in FIG. 2) along the provided guide from the S2 portion, and is housed in the sheet-waste housing section 309.

The sheet P from which the side edge part CP is trimmed is transported along the provided guide from the S2 portion to the first branch path S11 or the second branch path S12.

(2.5) Sheet-Waste Housing Section (2.5.1) Configuration of Sheet-Waste Housing Section As shown in FIGS. 4A and 4B, the sheet-waste housing section 309 includes the sheet-waste housing box 91 being an example of a side edge part housing portion, side edge part guides 92 being an example of a guide plate, and a second side edge part guide 93 being an example of a second guide plate.

The sheet-waste housing box 91 houses the trimmed side edge parts CP. The sheet-waste housing box 91 is mounted so as to be pulled out to the front surface side (operator side) of the post-processing apparatus 300.

The side edge part guides 92 are plate-shaped members provided obliquely toward the direction of gravitational force. As shown in FIG. 4B, the side edge part guides 92 are arranged at left and right to define a truncated V shape.

The second side edge part guide 93 includes plate-shaped members obliquely provided toward the direction of gravitational force similarly to the side edge part guides 92. The second side edge part guide 93 is normally arranged to define an inverted V shape between the side edge part guides 92 and the sheet-waste housing section 309.

(2.5.2) Housing of Side Edge Parts CP

The side edge part guides 92 are respectively provided below the left and right cutter units 80 in correspondence with the cutter units 80.

When the side edge parts CP with the lines 88 formed fall from the cutter units 80, front ends of the side edge parts CP are guided by inclined surfaces 92*a* of the side edge part guides 92, and move in a sliding manner in the horizontal direction (arrow R1 in FIG. 4A) on the inclined surfaces 92*a*. Then, rear ends of the side edge parts CP having rod shapes because the lines 88 are formed fall on the inclined surfaces 92*a* of the side edge part guides 92 (arrow R2 in FIG. 4A).

The side edge parts CP which are guided by the inclined surfaces 92*a* of the side edge part guides 92 and become substantially horizontal in the moving direction of the side edge parts CP are guided by inclined plates 93*a* of the second side edge part guide 93 arranged below the side edge part guides 92, fall substantially horizontally to the sheet-waste housing box 91, and are housed while distributed in the front-rear direction (near side and deep side) in the pull-out direction of the sheet-waste housing box 91. Consequently, the housing efficiency of the sheet-waste housing box 91 may be further increased (see FIG. 4B).

(2.5.3) Configuration of Second Side Edge Part Guide

As shown in FIG. 5, the second side edge part guide 93 includes left-right symmetrically provided inclined plates 93*a*, and a partition plate 93*b* that distributes the side edge parts CP falling to the left and right inclined plates 93*a*.

First ends of the left and right inclined plates 93*a* are supported rotatably in the vertical direction around a support shaft 93*c* as the rotation center relative to the partition plate 93*b*. Second ends of the left and right inclined plates 93*a* are respectively supported by support shafts 93*d* that are movably supported at guide holes 300*a* (see arrow R4 in FIG. 5) provided in the housing of the post-processing apparatus 300.

As shown in FIG. 6, guide rollers 93A and 93B are provided at both ends of the partition plate 93*b*. The guide rollers 93A and 93B are supported movably (see arrow R5 in FIG. 6) in a state urged downward by an urging member (not shown) in a guide hole 300*b* provided as a vertically long hole in the housing of the post-processing apparatus 300.

Consequently, the guide rollers 93A and 93B move in the vertical direction within the guide holes 300*b* and hence the second side edge part guide 93 is able to be transformed into a first form (see FIG. 6) having mountain-shaped or substantially mountain-shaped inclined surfaces in which both end portions of the inclined plates 93*a* are lower than a center portion, and a second form (see FIG. 7) having valley-shaped or substantially valley-shaped inclined surfaces in which both end portions of the inclined plates 93*a* are higher than the center portion.

(2.5.4) Transformation Mechanism

Figure 8B:
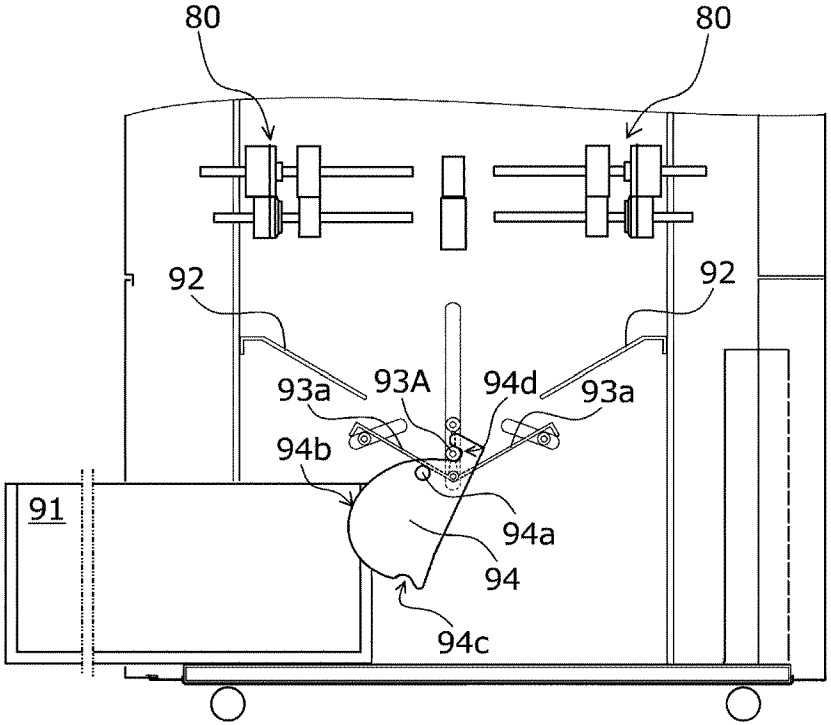
FIG. 8B is a schematic cross section of the sheet-waste housing section showing a second form of the second side edge part guide.
Figure 8A:
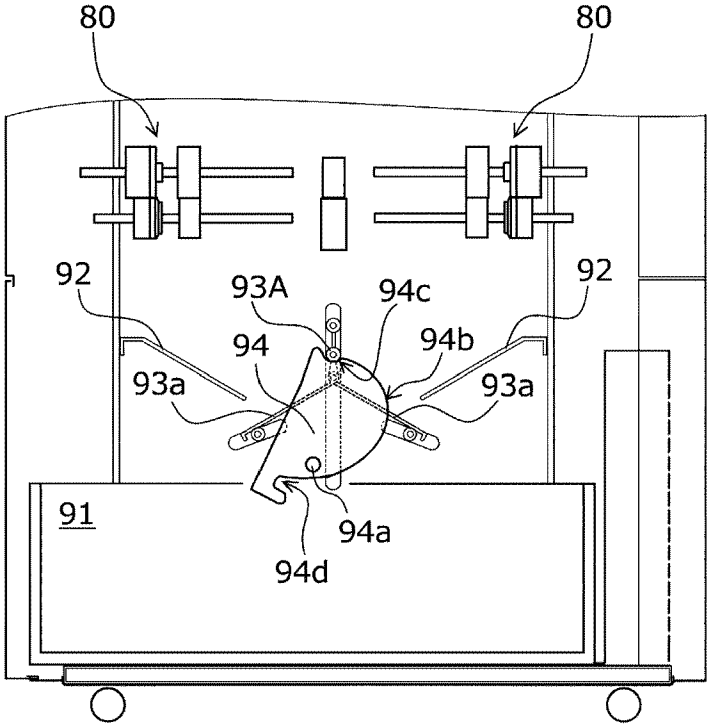
FIG. 8A is a schematic cross section of the sheet-waste housing section showing a first form of a second side edge part guide.
Figure 9B:
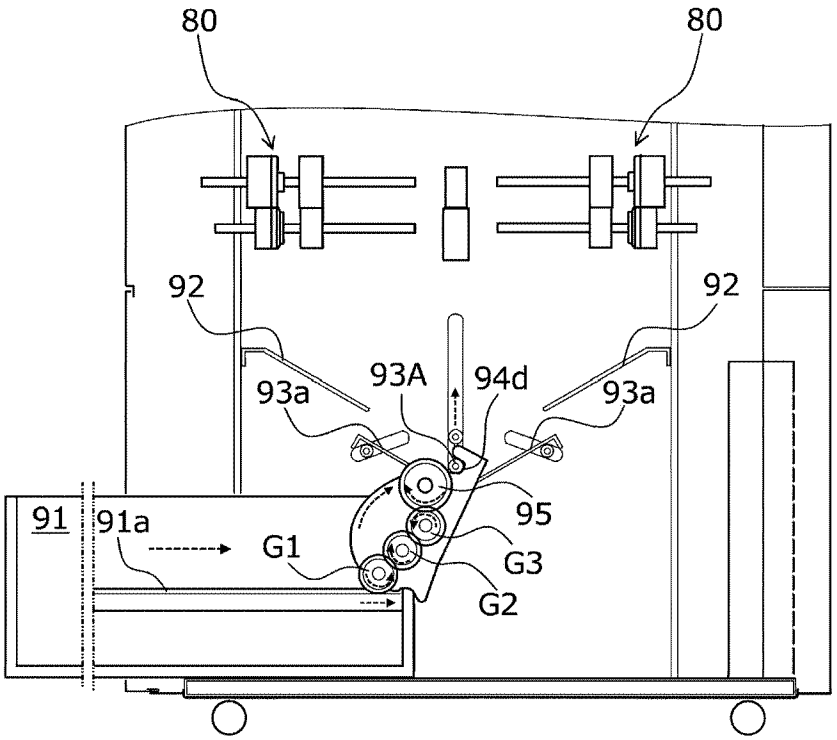
FIG. 9A and FIG. 9B are schematic cross sections of the sheet-waste housing section for explaining rotation of a vertical motion cam that is moved by a pull-out operation of the sheet-waste housing box.
Figure 9A:
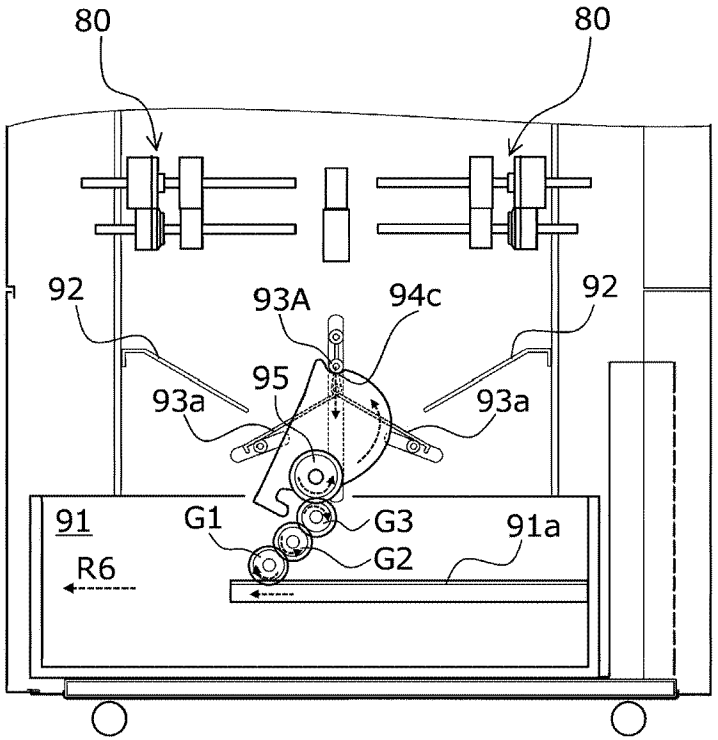

FIG. 8A is a schematic cross section of the sheet-waste housing section 309 showing the first form of the second side edge part guide 93, and FIG. 8B is a schematic cross section of the sheet-waste housing section 309 showing the second form of the second side edge part guide 93. FIG. 9A and FIG. 9B are schematic cross sections of the sheet-waste housing section 309 for explaining rotation of a vertical motion cam 94 that is moved by a pull-out operation of the sheet-waste housing box 91.

As shown in FIGS. 8A and 8B, the vertical motion cam 94 is rotatably provided at the housing of the post-processing apparatus 300. The vertical motion cam 94 includes a rotation shaft 94*a* and a cam surface 94*b* having engagement recesses 94*c* and 94*d* at both end portions.

As shown in FIG. 8A, when the sheet-waste housing box 91 is inserted into the housing of the post-processing apparatus 300, the vertical motion cam 94 is positioned in a state in which the engagement recess 94*c* is far to the upper side with respect to the rotation shaft 94*a* and engages with the guide roller 93A of the second side edge part guide 93.

In this state, the second side edge part guide 93 takes the first form having the mountain-shaped or substantially mountain-shaped inclined surfaces in which both the end portions of the inclined plates 93*a* are lower than the center portion. The side edge parts CP, which are guided by the inclined surfaces 92*a* of the side edge part guides 92 and fall, are dropped into the sheet-waste housing box 91 to distribute the side edge parts CP in the front-rear direction (near side and deep side) in the pull-out direction of the sheet-waste housing box 91. Accordingly, the housing efficiency of the sheet-waste housing box 91 is increased (see FIG. 4B).

Also, as shown in FIG. 8B, when the sheet-waste housing box 91 is pulled out from the housing of the post-processing apparatus 300, the vertical motion cam 94 rotates at about 180 degrees with respect to the rotation shaft 94*a* and the engagement recess 94*d* engages with the guide roller 93A of the second side edge part guide 93. In this state, the second side edge part guide 93 takes the second form having the valley-shaped or substantially valley-shaped inclined surfaces in which and both the end portions of the inclined plates 93*a* are higher than the center portion.

In this state, the second side edge part guide 93 takes a state in which the second side edge part guide 93 is able to receive the side edge parts CP, which are guided by the inclined surfaces 92*a* of the side edge part guides 92 and fall, with the valley-shaped or substantially valley-shaped inclined plates 93*a* and temporarily house the side edge parts CP. Even if the post-processing apparatus 300 continues the side edge part removal as the post-processing operation, the valley-shaped or substantially valley-shaped second side edge part guide 93 houses the falling side edge parts CP.

When the sheet-waste housing box 91 is inserted into the post-processing apparatus 300, the second side edge part guide 93 is transformed into the first form having the mountain-shaped or substantially mountain-shaped inclined surfaces in which both the end portions of the inclined plates 93*a* are lower than the center portion, and the temporarily housed side edge parts CP fall substantially horizontally to the sheet-waste housing box 91 and are housed in the sheet-waste housing box 91.

To be specific, the transformation between the first form and the second form of the second side edge part guide 93 is provided by a rack and pinion mechanism shown in FIGS. 9A and 9B.

The sheet-waste housing box 91 has a rack tooth 91*a* extending in the pull-out direction. The rack tooth 91*a* meshes with a pinion G1. The pinion G1 meshes with gears G2 and G3 thereby forming a gear train. The gear train transmits rotation to a cam gear 95 coaxially fixed to the rotation shaft 94*a* of the vertical motion cam 94.

Consequently, the rack tooth 91*a* moves in the pull-out direction and rotates the pinion G1 in synchronization with the pull-out operation of the sheet-waste housing box 91. Accordingly, the vertical motion cam 94 is rotated. To be specific, when the sheet-waste housing box 91 is pulled out from the post-processing apparatus 300, the rack tooth 91*a* integrally formed at the side portion of the sheet-waste housing box 91 moves (see arrow R6 in FIG. 9A), and the pinion G1 meshing with the rack tooth 91*a* rotates.

The rotation of the pinion G1 is transmitted to the cam gear 95 through the gear train formed of the gears G2 and G3 meshing with the pinion G1. The vertical motion cam 94 rotates while the cam surface 94*b* guides the guide roller 93A of the second side edge part guide 93 (see arrow in FIG. 9A), and the engagement recess 94*d* engages with the guide roller 93A of the second side edge part guide 93.

In the post-processing apparatus 300 according to this exemplary embodiment, the second side edge part guide 93 is transformed from the first form having the mountain-shaped or substantially mountain-shaped inclined surfaces into the second form having the valley-shaped or substantially valley-shaped inclined surfaces in synchronization with the pull-out operation of the sheet-waste housing box 91, and becomes able to temporarily house the side edge parts CP, which are guided by the side edge part guides 92 and fall.

Accordingly, the sheet-waste housing box 91 may be pulled out and the side edge parts CP being sheet waste may be thrown away while the post-processing operation of the post-processing apparatus 300 is continued without stop. Accordingly, a decrease in operation efficiency of the image forming system 1 may be restricted.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing apparatus comprising:

a side edge part removing portion that removes a side edge part from a sheet;

a side edge part housing portion that houses the side edge part of the sheet removed by the side edge part removing portion and that is able to be pulled out from an apparatus body;

a guide plate that is inclined in a direction intersecting with a moving direction of the side edge part and guides the side edge part removed by the side edge part removing portion along the moving direction of the side edge part to the side edge part housing portion; and a second guide plate that is arranged between the side edge part housing portion and the guide plate, and is able to be transformed into a first form having substantially mountain-shaped inclined surfaces in which both end portions of the second guide plate along the moving direction of the side edge part are lower than a center portion of the second guide plate, and a second form having substantially valley-shaped inclined surfaces in which both the end portions are higher than the center portion.

2. The post-processing apparatus according to claim 1, wherein the second guide plate is transformed from the first form into the second form when the side edge part housing portion is pulled out from the apparatus body, and the second guide plate is transformed from the second form into the first form when the side edge part housing portion is inserted into the apparatus body.

3. The post-processing apparatus according to claim 1, wherein the side edge part housing portion has a rack tooth formed along a pull-out direction of the side edge part housing portion, and a pinion gear group including a pinion gear that is able to mesh with the rack tooth rotates a cam mechanism that transforms the second guide plate between the first form and the second form.

4. An image forming system, comprising:

an image forming apparatus that forms an image on a sheet; and the post-processing apparatus according to claim 1.

* * * * *